US006131750A

United States Patent [19]

Harrington

[11] Patent Number: 6,131,750

[45] Date of Patent: Oct. 17, 2000

[54] CONNECTION SYSTEM FOR BOOM EXTENSION

[75] Inventor: Daniel L. Harrington, Lexington, Ky.

[73] Assignees: Link-Belt Construction Equipment Co; Sumitomo Construction Machinery, both of Lexington, Ky.

[21] Appl. No.: 08/864,605

[22] Filed: May 28, 1997

[51] Int. Cl.[7] ..... B66C 23/70

[52] U.S. Cl. ..... 212/177; 212/300

[58] Field of Search ..... 403/13, 14, 79, 403/157; 212/168, 177, 300, 292, 293

[56] References Cited

U.S. PATENT DOCUMENTS

| | | | |
|---|---|---|---|
| 3,043,394 | 7/1962 | Hall . | |
| 3,785,505 | 1/1974 | Keller, Jr. . | |
| 3,792,778 | 2/1974 | Sholl et al. | 212/292 |
| 4,141,455 | 2/1979 | Henderson et al. . | |
| 4,483,447 | 11/1984 | Bernabe, Jr. . | |
| 4,621,742 | 11/1986 | Rathi . | |
| 4,635,805 | 1/1987 | Mentzer . | |
| 4,653,655 | 3/1987 | Rathi et al. . | |
| 4,949,516 | 8/1990 | Long, Jr. . | |
| 5,082,128 | 1/1992 | Franzen et al. . | |
| 5,111,945 | 5/1992 | Hull et al. . | |
| 5,115,925 | 5/1992 | Koizumi . | |
| 5,281,078 | 1/1994 | Mills | 212/180 |
| 5,393,193 | 2/1995 | Dagg | 212/292 |
| 5,673,805 | 10/1997 | Chaffin | 212/348 |

FOREIGN PATENT DOCUMENTS

| | | | |
|---|---|---|---|
| 182695 | 7/1990 | Japan | 212/168 |
| 1062175 | 12/1983 | U.S.S.R. | 212/293 |

*Primary Examiner*—Thomas J. Brahan
*Attorney, Agent, or Firm*—King and Schickli, PLLC

[57] ABSTRACT

A connecting system for aligning the fly lug of a strut on a boom extension for connection to the boom head shaft of a crane boom. The apparatus includes an offset jack screw extending through a threaded aperture in the boom head shaft parallel to the strut of the boom extension and a laterally extending tab affixed to the fly lug. The jack screw has a swivel pad at the head that contacts the tab. Manual adjustment to the jack screw is operative to move the lug so that a hole for a pin aligns with a mating hole in the head shaft. The face portion of the swivel pad universally mates with the operative face of the tab that extends at a 10°–15° angle normal to the axis of the strut to cancel the induced turning moment caused by the offset of said jack screw.

4 Claims, 4 Drawing Sheets

CONNECTION SYSTEM FOR BOOM EXTENSION

TECHNICAL FIELD

This invention relates generally to forming a structural connection by a pin extending through mating holes; and more particularly, to a new and improved apparatus for assisting in aligning a strut on a boom extension with a boom head shaft of a crane boom for easy and efficient pin insertion to make the connection.

BACKGROUND OF THE INVENTION

Crane booms customarily have detachable boom extensions that are helpful in extending the reach of the boom. As the boom extension is not always required during crane operation, the boom extension is either removed or stored alongside the crane boom, as is shown in U.S. Pat. No. 4,141,455 to Henderson et al.

When the boom extension is required, it is attached to the crane boom using four structural connections. To make the connections, fly lugs that are preferably in the form of a clevis, are located at the end of the struts and aligned with and attached to the flattened ends of upper and lower boom head shafts located at the head of the crane boom. After the two primary clevis connections on one side of the boom extension are completed, it is pivotally rotated until the opposite or secondary fly/clevis lugs align with the corresponding flattened ends of the boom head shaft. Tapered pins are then inserted through the mating holes of these clevis connections; that is, the upper and then the lower fly lug and the corresponding ends of the boom head shaft are connected. This completes the secondary clevis connections, thereby securely attaching the boom extension to the crane boom.

Insertion of the pin to complete the upper secondary clevis connection is generally made without substantial difficulty. However, the insertion of the lower pin is often difficult or impossible due to the misalignment of the mating holes. Such misalignment can be caused by a combination of factors, including manufacturing tolerances, and over time wear on the crane parts. This misalignment tends to be compounded by the twisting or skewing force imparted to the boom extension, and thus transmitted through the strut to this final, unpinned fly lug by the weight of the boom extension itself.

Insertion of the final pin through misaligned holes has previously been attempted in several ways. One of the most common ways is by hammering on the fly lug and/or the pin until the pin holes are in substantial alignment and the pin is forced in place. This hammering technique is a feasible way to insert the final pin when there is only slight misalignment. However, when the final pin must be inserted through moderate to substantially misaligned holes, which is often the case, hammering the lug/pin is more troublesome. The worker hammering the lug/pin risks mashing a finger or worse. As will be realized this "make-shift" approach is also very time consuming. Further, hammering tends to eventually result in physical damage to the pin and/or the fly lug. Physical damage to the fly lug is particularly detrimental, as it is likely to simply add to the troublesome initial misalignment of the holes for the pins.

Final pin insertion has also been accomplished by lowering the crane boom to the ground to relieve the twisting/skewing force mentioned above. However, lowering the boom extension to the ground is not desirable for several reasons. Contact with the ground increases the risk of damage to the boom extension and other parts that are important for the operation of the crane, such as the fly head sheave assembly located at the end of the boom extension. Lowering the boom all the way to the ground also requires more than one worker for efficient final pin insertion. One worker must operate and adjust the crane boom to place pressure on the boom extension to try to force the final fly lug into position, while another observes the process to signal when alignment of the pin holes is complete. Finally, although such lowering the boom extension to the ground and pressuring the boom extension can potentially relieve any skewing misalignment caused by the weight of the extension, it will not aid in correcting misalignment due to manufacturing tolerances, wear or damage from prior hammering.

One proposal for overcoming these difficulties is demonstrated in U.S. Pat. No. 5,111,945 to Hull et al. In the '945 patent, the pin holes are aligned using the force of the telescoping boom against a device attached adjacent the secondary side of the boom head (see FIG. 3 of the '945 patent). While the '945 patent overcomes some disadvantages, several limitations remain. The arrangement shown in the '945 patent is first of all very complicated and relatively expensive to install and maintain. Furthermore, just like the prior art process of using the ground to force the holes into place, this approach requires more than one worker to accomplish final pin insertion; one to operate the boom and one to watch and signal. Further, this arrangement relies on the delicate and tedious operation of the crane to align the pin holes. Thus, it requires an experienced crane operator to be one of the workers to perform the operation. Also, this arrangement requires full retraction of the telescoping boom prior to final pin insertion.

Thus, a need exists for an improved apparatus for aligning holes to assist in insertion of a pin to make a structural connection. More specifically, the need is particularly acute for such a system to align the final or secondary lower strut on a boom extension of a crane so that the pin holes of its fly lug and the boom head shaft mate, thus allowing easy and efficient pin insertion. This is particularly needed where a limited number of workers are present or available for assisting in the attachment of the boom extension. This improved pin insertion is to be accomplished by the inventive apparatus by utilizing only one worker, without special skills, requiring no use of power or separate tools, and performing the task without lowering the boom all the way to the ground or fully retracting the telescoping boom.

SUMMARY OF THE INVENTION

Thus, with the above needs for improvement in focus, it is a primary object of the present invention to provide an improved apparatus for making or forming a connection including aligning mating holes in two structural parts to assist in pin insertion to make the connection.

It is another and related object to provide such a system for forming a connection for the final strut of a boom extension on a crane boom, whereby any initial misalignment of the pin holes of the boom extension and boom head shaft are corrected, thereby allowing for easy and efficient pin insertion.

Another object of the present invention is to provide an apparatus for making a connection by effecting the alignment of a boom extension with a crane boom that allows for final pin insertion without the use of separate tools.

Still another object of the present invention is to provide a system for aligning and forming a clevis connection, such as for attaching a boom extension to a crane boom that can be manually operated in a very simple manner and without completely lowering the boom to the ground.

Yet another object of the present invention is to provide an apparatus for alignment and connection of a boom extension with the head shaft of a crane boom and inserting a pin to form the connection that can be easily operated by one worker without substantial training or effort.

A further object of the present invention is to provide a system for boom extension attachment to a crane boom with assistance in the alignment process for the boom extension that can be operated without using the power of the crane.

It is still another object of the present invention to provide a system for forming a connection with assistance in aligning the holes for the pin insertion, such as a connection of a boom extension to a crane boom, which system allows the boom extension to be so attached without fully retracting the telescoping boom head of the crane.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations pointed out in the appended claims.

To achieve the foregoing and other objects, and in accordance with the preferred embodiment of the present invention as described herein, an improved apparatus is provided for aligning and forming a connection of structural parts using a pin extending through mating holes. In a preferred embodiment, the connection is for a boom extension on a crane boom. An important aspect of the invention involves assisting in the alignment of the boom extension for easy pin insertion through aligned holes. The pin extending through said holes serves to connect the strut of the boom extension to the crane boom. An actuator on the crane head shaft comprises a rod assembly for engagement with a tab located on the boom extension to provide the alignment. The rod assembly extends through a threaded aperture running parallel to the strut of the boom extension and located at the end of the boom head shaft. The cooperating tab is attached to the side of the fly or clevis lug at the end of the final strut of the boom extension to be connected. The preferred embodiment matches a clevis to a flattened shaft to form a strong clevis connection of the extension/boom. Further, the tab is affixed to the fly lug at an acute angle that enhances the alignment procedure by canceling the lateral force imposed by the turning moment that occurs as a result of the offset of the actuator from the holes being aligned.

According to one aspect of the invention, the rod assembly is manually actuated from a retracted home position to extend through the head shaft, and upon contact with the tab continued movement brings the holes of the clevis on the boom extension into precise alignment with the mating hole of the boom head shaft. That is, according to the invention the holes of both parts of the clevis connection are precisely aligned and the pin is then easily installed without hammering or other forceful action.

In the preferred embodiment of the invention, the rod assembly is formed by a jack screw having a head end and a handle end. The jack screw is threadedly engaged with a threaded aperture in the boom head shaft that extends towards the tab attached to the fly lug. A T-handle is preferably slidably engaged in the handle end of the jack screw, thus facilitating the manual rotation of the jack screw, and capable of providing added leverage, if required. A swivel assembly is fixed to the head end to engage the tab on the lug. As can be appreciated, the jack screw is permanently attached to the boom head shaft so that it is always available for use.

Of course, other equivalent configurations for the connection falling within the broadest principles of the present invention are contemplated, as defined by the appended claims. For example, the connection being made can be for similar first and second structural parts that are being pinned together. This is particularly useful where the relative free alignment of the mating holes in the parts is restricted by other connected parts. Further, an equivalent form of the actuator for applying the aligning force is contemplated. For example, a non-threaded cylindrical rod slidably engaged in a smooth-walled aperture and moved as reciprocating actuator is within the broadest scope of the invention. The actuator may in this instance include a cam and/or lever arrangement attached to the outside of boom head shaft (not shown) acting to push the rod against the tab.

The swivel assembly on the head end of the jack screw of the preferred embodiment comprises a nut having a socket located in an inner recess at one end and a threaded portion located at the other end. A threaded orifice allows the nut to be fixedly attached for rotation with the head end of the jack screw. A swivel pad of the swivel assembly has a flat face portion and a lower, spherical ball portion that fits into the socket. As can be appreciated, this ball and socket joint allows the swivel pad to automatically match the angle of the mating face of the tab. The jack screw and the nut rotate relative to the face portion during the hole alignment procedure.

It will be appreciated either side of the boom extension can be designated for the final clevis connection. This designation, which is always with respect to the lower boom head shaft, depends on which side of the head is chosen for primary engagement of the boom extension and storage when not in use. Of course, if desired a connection and actuator of the present invention can be provided on both sides to simplify the connection process in the event more radical realignment is needed with one particular crane design.

When the final clevis connection is to be made, the jack screw is withdrawn to its home position. The T-handle of the jack screw is then rotated, thereby actuating the jack screw with respect to the threaded aperture. This initial rotation of the jack screw is continued until the face portion of the swivel pad first pushes against the tab. It can be appreciated at this time that as the force required for rotation is increased to actually push the tab and the clevis lug for final hole alignment, the cross member of the T-handle can be shifted to provide more leverage. The manual rotation of the jack screw is all that is required for full alignment of the holes of the clevis connection and thus insertion of the pin to complete the connection.

It will now be realized that because the jack screw is offset from the axis of the strut, as it pushes against the tab, the force moving the fly lug includes a turning moment. Advantageously, the selected angular attachment of the tab to the lug aids in offsetting this turning moment by compensating for eccentric force being applied. Preferably, an acute angle of approximately 10°–15° to a line perpendicular or normal to the movement and the axis of the strut is selected.

As the jack screw is relatively rapidly rotated for the initial rough adjustment, the swivel pad is first seated on the tab, and then full manual rotation firmly pushes against the tab. This rotation continues until the pin holes of the clevis connection are almost in the desired alignment. At this point, the rotation is slowed and since the force is being manually imparted by the jack screw, it can be finely controlled until the holes are fully aligned. The pin is tapered to further assist in the insertion through the three aligned pin holes of the clevis connection. The keeper pin is secured in place, thus completing the final clevis connection secure attachment of the boom extension to the crane boom. The jack screw may then be reversed and rapidly returned to the retracted home position.

According to another feature of the invention, the apparatus can also be used to assist in removing the final pin when detaching the secondary side of the boom extension. As detailed above, the jack screw is actuated to apply force against the tab until the pin is able to be moved by minor or finger pressure within the hole. This lower pin is then removed from the hole by hand, or by light tapping with a hammer. The jack screw is then returned to the retracted home position in readiness for the next time the boom extension is to be attached in its operative position in the manner pointed out above. To complete the detachment of the secondary side of the boom extension, the corresponding upper pin is removed. The boom extension can then be rotated into its stowed position on the side of the main boom, or removed from the crane entirely.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention and, together with the description, serve to explain the principles of the invention. In the drawings:

FIG. 3*d* is an enlarged cut-away side view of the completed clevis connection, showing the pin extending through the mating holes of the lower, secondary fly lug and boom head shaft; and FIG. 4 is an enlarged detailed side view of the swivel assembly located at the head end of the jack screw, showing the ball and socket joint.

Reference will now be made in detail to the present preferred embodiment of the invention, an example of which is illustrated in the accompanying drawings.

BEST MODE OF CARRYING OUT THE INVENTION

Figure 1:
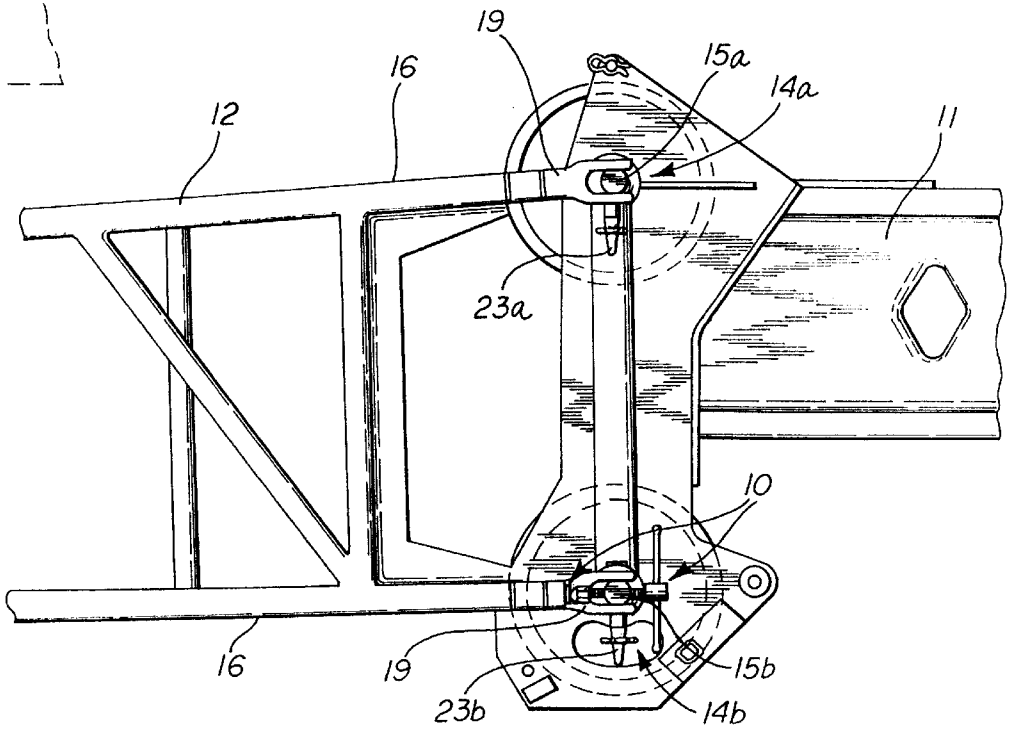
FIG. 1 is a top plan and cut-away view of the crane boom with the primary clevis connections completed and in place, and showing the pivotal rotation of the boom extension about the boom end toward its operative position for completing the secondary clevis connections.
Figure 1A:
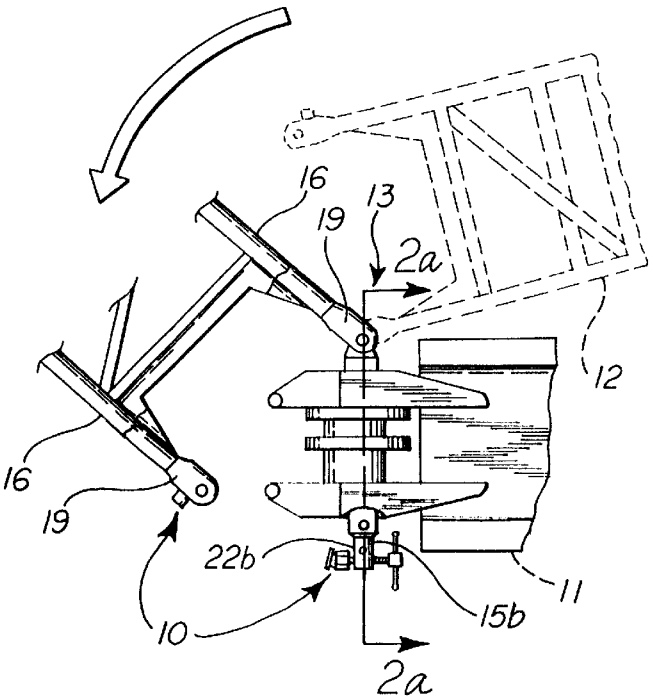
FIG. 1*a* is an enlarged top, cut-away view, illustrating in more detail the boom head of FIG. 1, but showing the top strut and fly lug of the secondary side removed to expose the tab located on the outside of the lower fly lug and the jack screw threadedly engaging the lower boom head shaft.

In FIGS. 1 and 1*a,* an apparatus for aligning and forming a structural connection between two structural parts is illustrated. Specifically, in the preferred embodiment shown, it takes the form of an apparatus 10 mounted on a boom head of a crane boom 11 with a stowable truss-type or lattice-type boom extension 12. To be stowed, the boom extension 12 pivotally swings into position on the side of the boom 11 about primary clevis connections 13. After rotation, the upper and lower secondary clevis connections 14*a*, 14*b* are sequentially made through insertion of a pin in mating holes in the upper and lower boom head shafts 15*a*, 15*b* (see FIGS. 2 and 2*a*). Of course, it is contemplated that the boom extension 12 can be detached from the crane boom 11, as well as being stowable.

Figure 2:
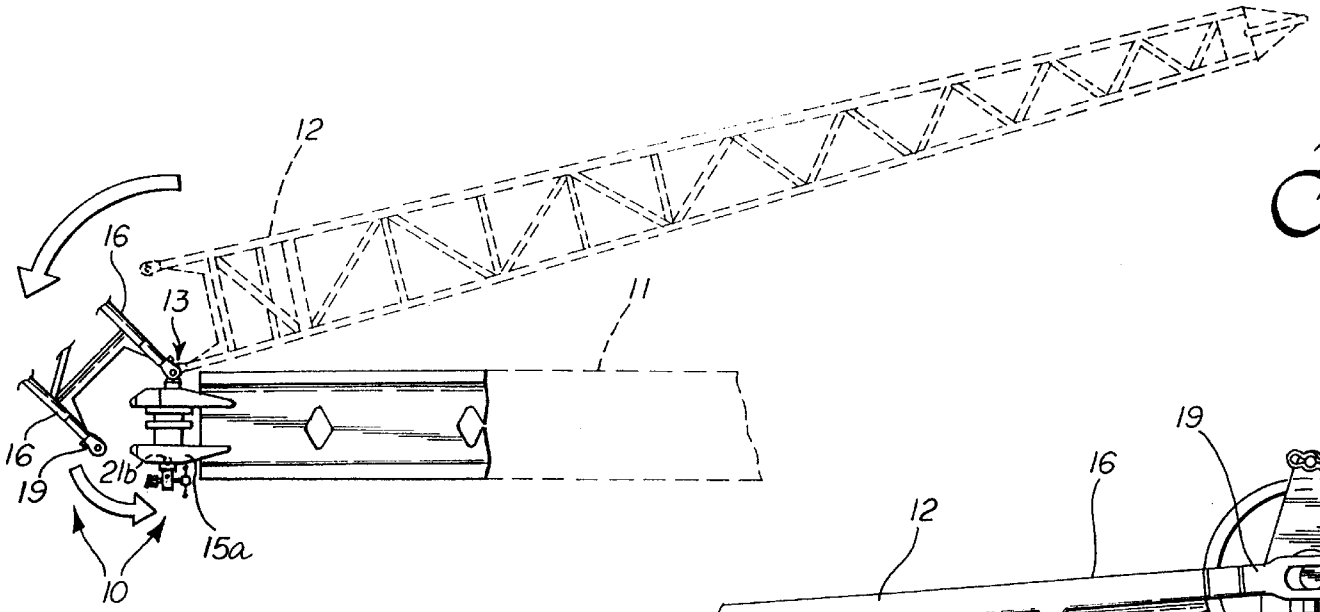
FIG. 2 is an enlarged side view with a boom extension completely attached to the boom head showing the completed upper and lower secondary connections including the pins in place to secure the boom extension.

The details of the completed secondary clevis connections 14*a*, 14*b* are best shown in FIG. 2. Each strut 16 forming a structural part of the boom extension 12 terminates in a fly or clevis lug 19. To connect the boom extension 12 to the boom head shafts 15*a*, 15*b*, the upper fly/clevis lug 19 receives the upper boom head shaft 15*a*. Similarly, the lower fly clevis lug 19 receives the lower boom head shaft 15*b*.

Figure 2A:
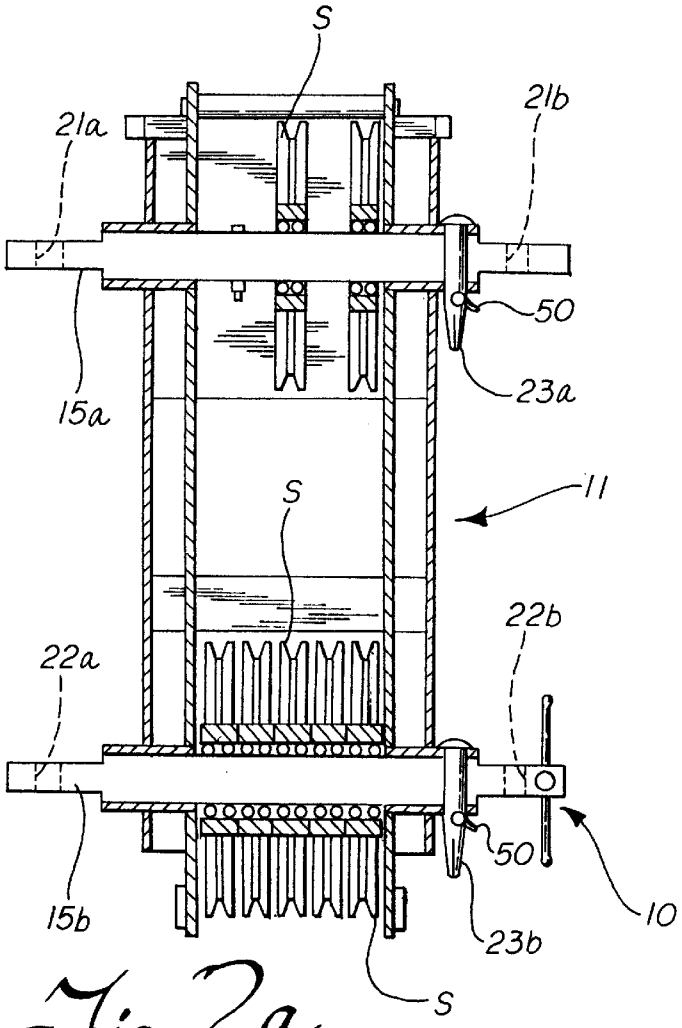
FIG. 2*a* is a transverse cross-section view of the boom head showing the upper and lower boom head shafts of the crane boom and the corresponding sheaves, the boom extension removed and the pins on the secondary side in storage.

As can be seen in FIG. 2*a,* the upper and lower boom head shafts 15*a*, 15*b* extend horizontally across the head of the boom and support sheaves S which are used to guide the cable during the operation of the crane. The ends of these shafts 15*a*, 15*b* are flattened to accommodate the lugs 19. Extending transversely through the ends of the upper boom head shaft 15*a* are primary and secondary holes 21*a,* 21*b,* respectively. Similarly, the lower boom head shaft 15*b* has holes 22*a,* 22*b*.

As shown in FIG. 2*a* an upper pin 23*a* on the secondary side is in a stored position in readiness to be moved into the operative connecting position once its fly lug 19 is brought into position (see FIG. 2). Similarly, the lower pin 23*b* is stored but ready to move into operative position once the lower lug 19 is moved into place, as taught by the present invention.

Once aligned, insertion of the upper pin 23*a* is made through the mating holes, including the hole 21*b*. Generally, this clevis connection 14*a* is made without difficulty (see FIG. 2). The lower clevis connection 14*b* is then ready to be made. However, as described above, the holes of the fly/clevis lug 19 and lower head shaft hole 22*b* are inherently misaligned (see FIG. 3*a*). To solve this misalignment problem, the aligning/forming apparatus 10 of the present invention, particularly adapted for easily and efficiently aligning these holes and forming the structural connection, is provided.

A detail of this lower clevis connection 14*b* is shown in FIGS. 1*a* and 3*a*–3*d*. An actuator 30 that takes the form of a rod assembly extends through a threaded aperture at the end of the lower boom head shaft 15*b* and a tab 31 is affixed, such as by welding, to the outside of the lower fly lug 19. In the preferred embodiment, the actuator 30 comprises a jack screw 32 having a swivel assembly 33 at the head end and a T-handle 35 through the opposite, or handle end 36.

The handle end 36 of the jack screw has a cylindrical collar 37. An aperture extends laterally through the center of the collar 37, to accommodate the T-handle 35.

The jack screw 32 threadedly engages the aperture in head shaft 15*b*. The swivel assembly 33 threadedly engages the head of the jack screw 32 in orifice 42 and is locked in place by suitable means, such as Loctite® adhesive, a product of Loctite Corp., Newington, Conn. A detail of this swivel assembly is shown in FIG. 4.

The other end of the swivel assembly 33 comprises recess 41 receiving a swivel pad 43 to form a ball and socket joint. More specifically, the swivel pad has a face portion 44 and a ball portion 45. The ball and socket joint thus formed advantageously allows the swivel pad 43 to move in a universal fashion to mate with the operative face of the tab 31. The movement provided in accordance with the present invention is approximately 10°–15° (see also FIG. 3*b*).

The face portion 44 of the swivel pad 43 provides the desired universal engagement of the jack screw 30 with the operative face of the tab 31. As indicated above, the tab 31 is positioned so that it extends angularly outwardly from the fly/clevis lug 19 at an acute angle normal to the axis of the strut 16. This provides an operative face of the lug 19 at approximately 10°–15° that advantageously cancels the turning moment imposed by the offset of the jack screw 30. In other words, the eccentric loading placed on the outside of fly lug 19 by the jack screw 32 pushing against the tab 31 (toward the left in FIG. 3*a*) is offset by the 10°–15° angle of the operative face of the tab tending to push the lug 19 back to the right. Of course, the preferred angle of attachment of the lug and the angle of the operative face depends on the amount of the offset of the actuator 30.

As presently envisioned, the engagement angle is determined by experimentation. For example, after welding the tab 31 in place so that the lug 19 moves slightly to the left (FIGS. 3*a*–3*c*), the angle of the operative face 31 can be increased by grinding until the additional force vector to the right provides the perfect alignment needed as the jack screw is rotated.

Figures 3A, 3B, 3C:
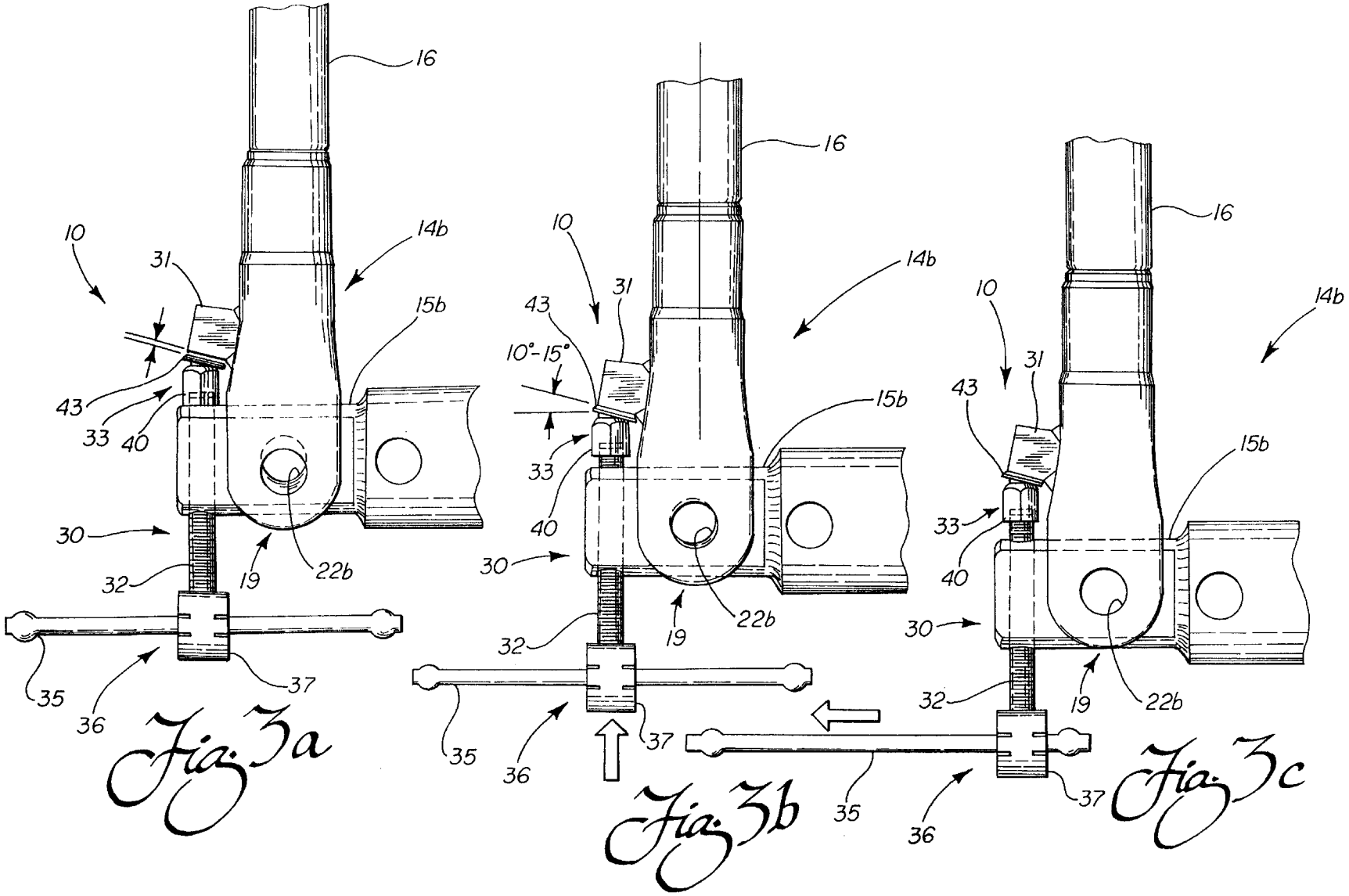
FIGS. 3*a*–3*c* are top views illustrating the progression of the alignment and forming of a clevis connection using the apparatus of the present invention and providing a detailed view of the final connection being made through the lower boom head shaft of the preferred embodiment.
Figure 7:
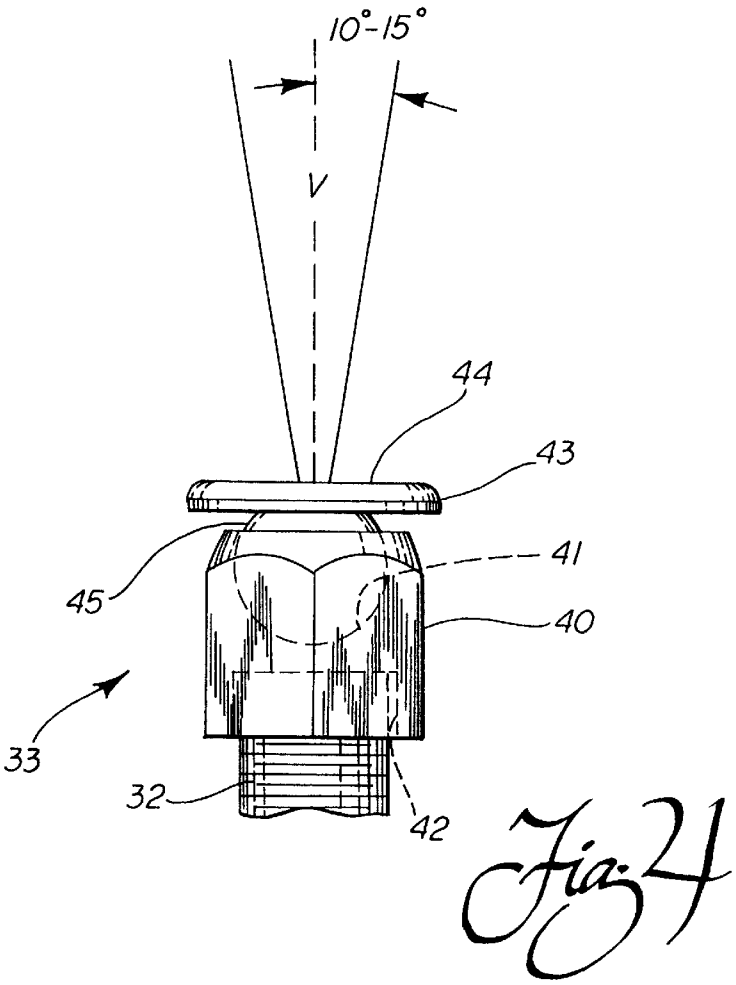
Figure 7D:
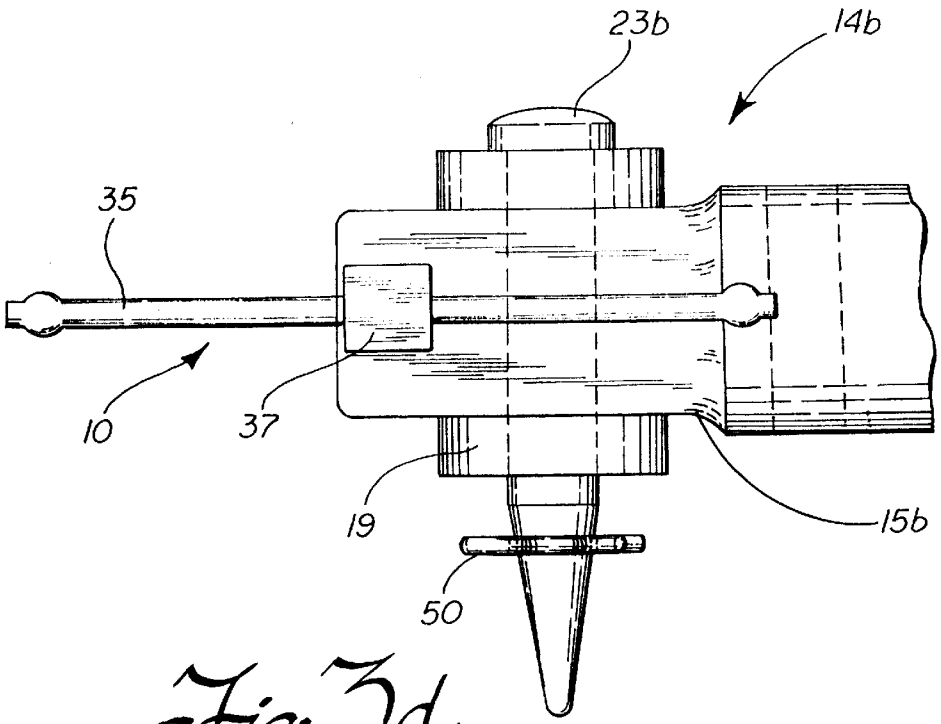

The preferred smooth progression of the alignment of the holes in the fly/clevis lug 19 and the hole 22*b* in the head shaft 15*b* is thus highlighted in FIGS. 3*a*–3*c*. Manual rotation of the jack screw using the T-handle 35 pushes the face portion 44 of the swivel pad 43 (see FIG. 4) against the tab 31. Advantageously, the transmission of the aligning force from the rotation of the jack screw is easy and efficient. No special tools are required and movement of the crane boom 11 is not necessary. The operator of the crane simply positions the boom 11 at about eye level above the ground. The boom extension 12 swings from the stowed to the operative position (FIG. 1), and then the clevis connection 14*a* is made. Next, the operator simply manually adjusts the alignment of the holes of the clevis connection 14*b*, the pin 23*b* is moved from the stored position (FIG. 2*a*) to the operative position (FIGS. 2 and 3*d*). Keeper pin 50 is installed and the operator can then return to the cab of the crane to perform the assigned work.

Advantageously, the T-handle 35 of the jack screw 32 allows the operator/worker to finely adjust the alignment. Rapid rotation to start and bring the holes almost into alignment may be followed with slower, fine tuning of the adjusted position. If necessary during the final few rotations of the jack screw 32, the T-handle 35 can be shifted to provide more leverage (see FIG. 3*c*). Upon alignment, the pin 23*b* may be easily inserted through the hole 22*b*. This lower clevis connection 14*b* completes the attachment of the boom extension 12 to the crane boom 11 (see FIG. 3*d*) in an easier and more efficient manner than heretofore possible.

After final pin insertion, the actuator 30 is retracted away from the tab 31. Of course, this is easily accomplished by rapid manual rotation of the T-handle 35 in the opposite direction from that described above.

In brief, to rotate the boom extension back to the stowed position, the pins 23*a*, 23*b* are removed in the reverse order of which they were installed. This is usually accomplished by removing the keeper pin 50 and light tapping with a hammer. If light tapping does not force the lower pin 23*b* through the holes due to the binding action caused by the weight of the boom extension, the aligning/forming apparatus 10 of the present invention may be used to realign the holes to loosen the pin 23*b*. After removal of the pins 23*a*, 23*b* they are returned to their respective storage holes (FIG. 2*a*) and the keeper pins 50 reemployed.

In summary, it will be realized that the results and advantages of the present invention are to provide an apparatus 10 allowing easier and more efficient alignment and formation of a structural connection between two parts, such as the boom extension 12 and the boom 11 of a crane. The operator alone, or other single worker, using the simple manual apparatus 10 of the present invention can perform the task. Notably, this is done without using the power of the crane or separate tools. In the preferred embodiment, the jack screw 32 threaded through the boom head shaft 15*b* adjacent to the final clevis connection to be made simply pushes against a tab 31 located on the side of the fly lug 19. The tab 31 is affixed to the lug at an angle and has an operative face specifically formed at about 10°–15° normal to the axis of the strut 16 to offset the turning moment or eccentric force created by the side placement of the tab. A swivel assembly 33 assures proper engagement of the jack screw 32 with the tab 31 through universal movement. The rotary action of the jack screw 32 can be fine turned as the T-handle 35 is rotated, first rapidly and then more slowly and with greater force until the clevis connection 14*b* is finished.

The foregoing description of a preferred embodiment of the present invention has been presented for purposes of illustration or description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. An apparatus for aligning and forming a structural connection between a boom extension on a crane boom including at least one strut terminating in a fly lug having a hole and a mating hole on said boom, comprising:

an actuator located on said boom and extending toward the strut adjacent the fly lug for moving said fly lug;

a tab projecting from said fly lug being aligned with said actuator, said tab adapted to be positioned for engagement by said actuator to provide the aligning movement;

a pin for insertion through the holes;

said tab is offset from the axis of said strut and said actuator comprises a jack screw for threaded engagement in an aperture on said boom, said jack screw having a head end for engagement with said tab and a handle at the other end;

a swivel assembly attached to the head end of said jack screw for contacting said tab; and the operative face of said tab extends at an acute angle outwardly normal to the axis of said fly lug, whereby upon alignment of the fly lug of the boom extension with the boom, easy and efficient pin insertion is made for forming the connection.

2. The aligning and forming apparatus of claim 1, wherein said swivel assembly comprises:

a nut having an inner recess forming a socket at one end, a threaded orifice formed at the other end; and a swivel pad having a face portion for contact with the operative face of said tab and a ball portion extending away from said pad and retained in said socket for universal movement, whereby said swivel pad mates in a universal fashion with said tab.

3. An apparatus for aligning and forming a structural connection between a boom extension on a crane boom including at least one strut terminating in a fly lug having a hole and a mating hole on said boom, comprising:

an actuator located on said boom and extending toward the strut adjacent the fly lug for moving said fly lug;

a tab projecting from said fly lug being aligned with said actuator, said tab adapted to be positioned for engagement by said actuator to provide the aligning movement;

a pin for insertion through the holes;

said tab is offset from the axis of said strut and includes an operative face in the direction of said actuator;

said operative face of said tab extends at an acute angle outwardly normal to the axis of said fly lug; and the angle of operative face being sufficient to cancel the turning moment imposed by the offset of said actuator.

4. The aligning and forming apparatus of claim 3, wherein said acute angle is approximately 10°–15°.

* * * * *